United States Patent [19]

Lhuillier

[11] Patent Number: 4,898,541

[45] Date of Patent: Feb. 6, 1990

[54] MULTIPLE CONNECTION DEVICE

[75] Inventor: Christian Lhuillier, Clamart, France

[73] Assignee: Framatome, Courbevoie, France

[21] Appl. No.: 251,490

[22] Filed: Sep. 30, 1988

[30] Foreign Application Priority Data

Sep. 30, 1987 [FR] France ..... 87 13502

[51] Int. Cl.[4] ..... H01R 13/631

[52] U.S. Cl. ..... 439/248; 439/296; 439/342; 439/376

[58] Field of Search ..... 439/246, 248, 296, 304, 439/318, 310, 324, 338, 342, 374, 376, 247

[56] References Cited

U.S. PATENT DOCUMENTS

| | | | |
|---|---|---|---|
| 3,089,925 | 5/1963 | Landstrom | 439/296 X |
| 4,265,503 | 5/1981 | Baur | 439/310 X |
| 4,778,400 | 10/1988 | Jacobs | 439/374 X |

*Primary Examiner*—Eugene F. Desmond

*Attorney, Agent, or Firm*—Pollock, Vande Sande & Priddy

[57] ABSTRACT

A connection device includes two assemblies, movable towards each other. One of the assemblies has a first mechanical connection plate unit and a first connection element fixed to the plate unit. The other assembly includes a second mechanical connection plate unit and a second connection element movable with respect to the second plate unit in a direction parallel to the engagement direction. The second plate unit includes centering pins for engaging the first plate and providing relative centering of the two plates, remote controlled for locking the plate units one on the other and in aligned position of the contacts. Motors are carried by the second plate unit for moving the second connection element with respect to the second plate unit between a rear position in which the contacts of the elements are mutually separated even when the plate units are in contact with each other and a forward position in which the contacts of the two elements are in mutual engagement.

8 Claims, 4 Drawing Sheets

MULTIPLE CONNECTION DEVICE

BACKGROUND OF THE INVENTION

1. Technical Field

The invention relates to self-aligning multiple connection devices which can be remotely actuated for connection and disconnection without it being necessary to ensure perfect initial alignment of the two mating assemblies forming a connection device.

There is a need for multiple connection devices fulfilling this function in various technical fields, when the connection device is so located that access by an operator is difficult or impossible. Examples are the nuclear, steel making, agroalimentary fields and the exploitation of sea beds.

2. Prior Art

Multiple connection devices have already been proposed which include mating elements provided with means forcing them into alignment. Such devices include two assemblies one of which is movable towards and away from the other. One of the assemblies has a first mechanical connection plate and a first electrical connection or mating element with contacts which is secured to the plate; the other assembly includes a second mechanical connection plate and a second electrical connection or mating element with contacts adapted for engaging those of the first element. The second connection element is movable with respect to the second plate, along the contact engagement direction.

For simplicity, the term "contact" has been used above for designating the elements used for connection. This term must be understood quite generally as covering not only transmission of electric signals or power, but also optical or fluid transfer connections.

Most known connection devices of the above-defined type attempting to compensate, during engagement of the contacts, for the relative misalignments of the assemblies, transversal to the engagement direction and angularly are not completely satisfactory, particularly because they are complex in construction.

SUMMARY OF THE INVENTION

It is an object of the invention to provide a multiple connection device providing coupling of initially misaligned assemblies while using only relatively simple means.

The invention is particularly suitable for use in connection devices having a large number of contacts, which may reach and even exceed several hundreds. Then the force to be exerted for mutually engaging the contacts together may exceed 1000 daN. Such forces, if they are exerted while the contacts are out of alignment, may permanently deform the latter. The invention intends to overcome this problem, by allowing mutual engagement of the contacts only after alignment is achieved.

With this purpose in mind, there is provided a device of the above-defined type whose second plate includes: means intended to engage into the first plate and to provide relative centering of the two plates and remotely controllable for locking the plates one on the other in an aligned position of the contacts; and drive means for moving the second connection element with respect to the second plate between a rearmost position in which the contacts of the second element are separated from the contacts of the first element even when the plates are in contact and a forward position in which the contacts of the two elements are mutually engaged.

The two plates may be provided with sealing means mutually cooperating to separate the connection elements from the environment space when the plates are in contact. Self alignment of the plates with respect to each other may be achieved by engaging said means in appropriately shaped openings in the second plate. The means may include electric or fluid pressure motors for moving locking fingers carried by said members between a position locking said plates against each other and an unlocking position. The drive means for moving the second connection element with respect to the second plate may be an electric or fluid pressure jack.

The invention also provides a coupling device having two assemblies as defined above, one of which is rigidly fixed and the other of which is carried by a drive arm; self-alignment of the plates with respect to each other is provided by the flexibility of the arm, or by locating means forming a universal or Cardan joint between the arm and the plate. Resilient means for returning the plate to a rest position with respect to the arm may be provided.

The invention will be better understood from the following description of a particular embodiment of the invention, given by way of example. The description refers to the accompanying drawings.

DESCRIPTION OF A PREFERRED EMBODIMENT

Figure 1:
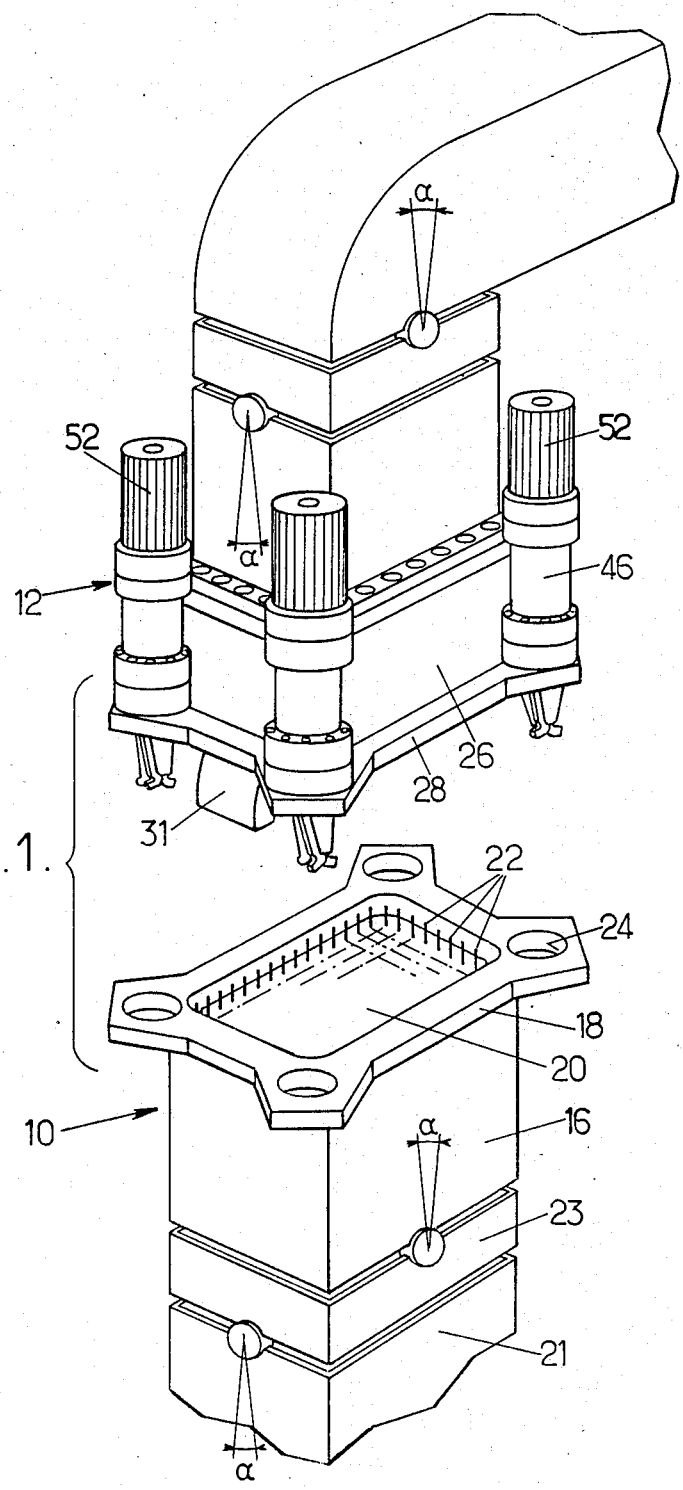
FIG. 1 is a simplified perspective view showing a multiple electric connection device of the invention, the two assemblies of the device being separated.
Figure 2:
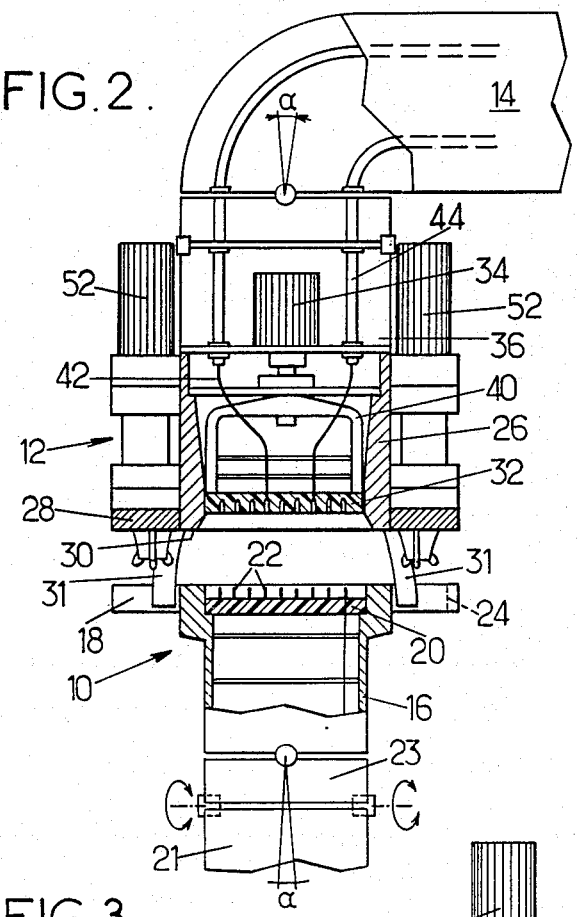
FIG. 2 is a partial sectional view of the assemblies, through the median plane of the device of FIG. 1.

Referring to FIGS. 1 and 2 a multiple connection device is shown which can be used for simultaneously connecting and disconnecting several hundred contacts or more. It includes a first assembly 10 which will be assumed hereafter to be stationary and which will be called "base" or "socket" assembly for this reason, having contact pins. The second assembly 12 is fixed to the end of an arm 14 for moving it toward and away from the base. Because this assembly is movable, it will be designated hereafter by the term "plug assembly". It should however be understood that such names are chosen solely for the sake of clarity and must not be considered limitatively.

The connection device is for permitting coupling and uncoupling without exerting torsional or flexure force on the contacts. For that, the device is designed so that coupling takes place in several successive phases:

movement of the plug toward the base by means of the arm, approximate alignment being sufficient;

rough mutual centering of the two plates during the final approach phase, until the plates of the assemblies come into contact one against the other;

precise alignment of the plates and locking of these plates one on the other, guaranteeing that they are held in a relatively immovable position;

connection, for example electric, by advancing one pluggable element towards the other.

As shown in FIGS. 1 and 2, base assembly 10 includes a case 16 integrally formed with a plate 18 in the form of a rectangular frame or sealingly fixed to this plate. A flat insulator block 20 through which the contacts 22 (which will be supposed to be pins) project is fixed within the case 16 parallel to the plate. Sealing of the contacts through block 20 may be by conventional connection means and will not be described further here. For easier manufacture and fitting of the insulator block and easier connection of the pins to wires, the insulator block is typically made in several modules each having 50 to 100 contacts.

The contacts are connected to supply wires, by soldering or crimping techniques which may also be conventional, at a location below block 20. The wires may belong to a cable which projects sealingly out of case 16 through a sealing collar (not shown) which may also be of conventional construction. This cable extends into a hollow guide sheath 21 connected to case 16 by a universal joint including an intermediate ring 23 and two sets of bearings. The maximum amount of angular deflection of the U-joint may be quite small, for example $\pm 10°$.

Plate 18 is formed with four lugs situated at the four corners of the rectangular frame, having holes 24 belonging to a mechanical system for mutually locking the two assemblies as will be seen later. The number of holes could be greater than four or, in certain cases, smaller.

The plug assembly 12 has a case 26 with an end plate 28 in the form of a rectangular frame having a size proportioned to that of plate 18. One and/or the other of plates 18 and 28 carries an annular seal 30 for application against a flat surface of the other plate or against a cooperating seal. As illustrated in FIGS. 1 and 2, case 26 further includes two curved guides 31 intended to straddle plate 18 and to provide a first transverse centering effect upon initial closing movement of the assemblies. The case 26 is fixed to arm 14 by a universal joint similar to that which connects case 16 to guide sheath 21.

Case 26 slidably receives a disc 32 for movement between a rearward position, as shown in FIG. 2, and a forward position. A jack 34 has a housing fixed to the bottom wall 36 of case 26 and a movable shaft for moving disc 32 between its rearward and forward positions. End-of-travel switches may be provided for stopping the jack when disc 32 reaches its end positions. The jack 34 may consist of an electric motor driving a rectilinearly movable guide stirrup 40 fixed to the disc and slidably mounted in case 26, through a screw-nut speed reducing gear. The free parts of the conductor wires 42 (two only of which are shown on FIG. 2) which extend between rigid tubes 44 fixed to the bottom wall 36 of the case and disc 32 are sufficiently loose to have the necessary flexibility.

Figure 3:
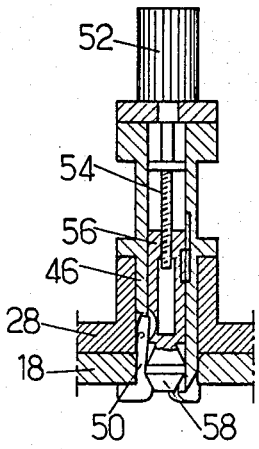
FIGS. 3 and 4 are detail views, in cross-section through the axis of one of the alignment and locking members of the device of FIG. 1, respectively after locking and before engagement.
Figure 4:
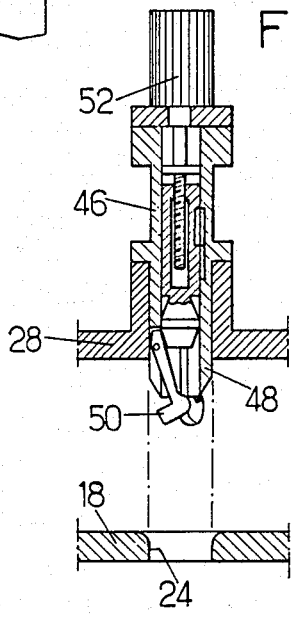

Plug assembly 12 includes alignment and locking units, four in number in the embodiment illustrated. All units are identical. Each has a tubular body 46 fixed to plate 28 (FIGS. 3 and 4). A plurality of fingers 50 spaced apart at equal angular intervals are mounted on body 46 for pivotal movement about respective pins between a retracted position close to the axis of the body (FIG. 4) and a locking position remote from said axis (FIG. 3). When the fingers are in retracted condition, the unit can pass through the respective hole 24.

Each alignment member has a motor 52 for moving fingers 50 between the positions shown in FIGS. 3 and 4. Motor 52, like motor 34, may be an electric motor with a speed reducing mechanism, for example formed as a screw 54 and a nut 56. The nut has a slidable non-rotatable connection with body 46 and has a protruding head 58 for forcing the fingers into their end positions.

Once the fingers have been brought into the spread out position in which they lock the plates against each other, they must remain locked, even if there is a failure of power supply to motors 52. To obtain this result, a transmission mechanism preventing reverse movement may be located between motor 52 and the fingers and/or the motors may be provided with a brake. To avoid risks due to accidental electric uncoupling, motor 34 may also be provided with a brake and/or connected to stirrup 40 by means of a mechanical transmission gear preventing reverse movement transmission from the stirrup.

Motors 52 are fed in parallel relation from a common control circuit (not shown) which must ensure complete synchronism in operation, so that clamping of the plates against each other takes place evenly. The forces exerted must be sufficient to overcome the friction forces opposing complete engagement. They must also be compatible with the required air-tightness. Such results may for example be obtained by using electric step-by-step motors or with a servosystem.

The connection and disconnection operations take place in several successive steps. In the case of connection, the steps may be as follows:

movement of plate 28 of plug assembly 12 towards plate 18, with approximate alignment, fingers 50 being retracted and the insulator block 32 being in its upper position;

progressive centering of plate 28 with respect to plate 18, provided by the noses 48 of the alignment members, until the plates 28 and 18 come into contact;

locking of the plates one on the other by actuating the motors 52 for spreading the fingers apart, whereby precise fine alignment conditions are maintained;

energization of motor 34 to move the insulator block 32 forwardly over a distance which will be generally of some millimeters until complete engagement of the contacts is obtained.

The order of operations is reversed for disconnection.

Figure 5:
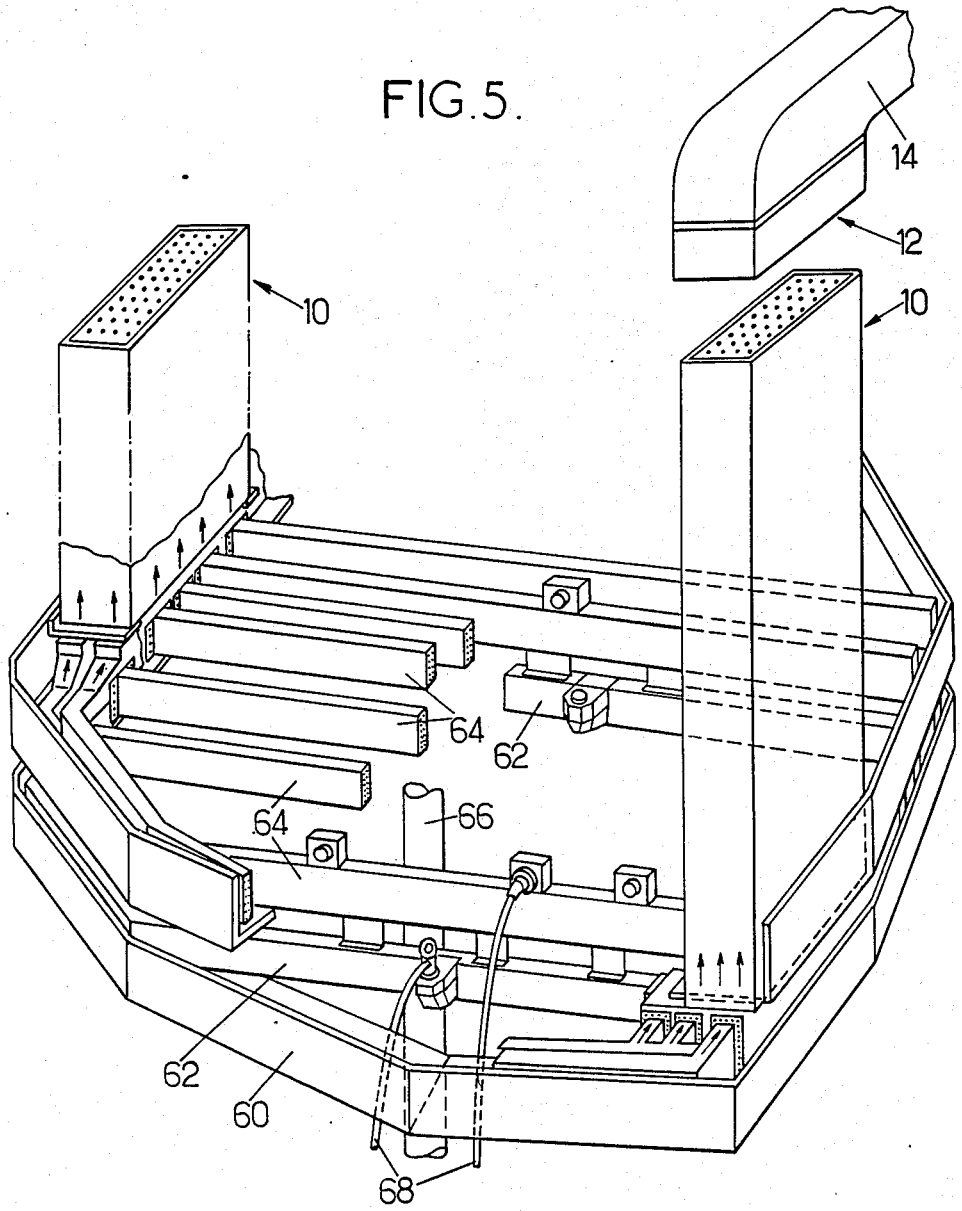
FIG. 5 shows the first assemblies of several connection devices of the invention, mounted above the vessel of a nuclear reactor.

FIG. 5 shows, by way of example, the base assemblies 10 of two connection devices for connecting power and data signal conductor wires, some of which project through the cover of a nuclear reactor vessel (not shown), with external apparatuses. All base units will generally be at the same level, higher than the walkways provided above the cover. Only a lower walkway 60 has been shown in FIG. 5. It may carry channels 62 for cables which carry measurement signals indicating the state of the spectral shift cluster control mechanisms and channels 64 for cables leading electric power to the control mechanisms. One tube 66 for accommodating mechanisms and/or cables 68 has been shown. A median walkway may in the same way carry the cables corresponding to the control bar mechanisms, etc. One plug assembly 12 only has been shown, carried by a movable arm 14 whose end part is shown schematically.

Figure 6:
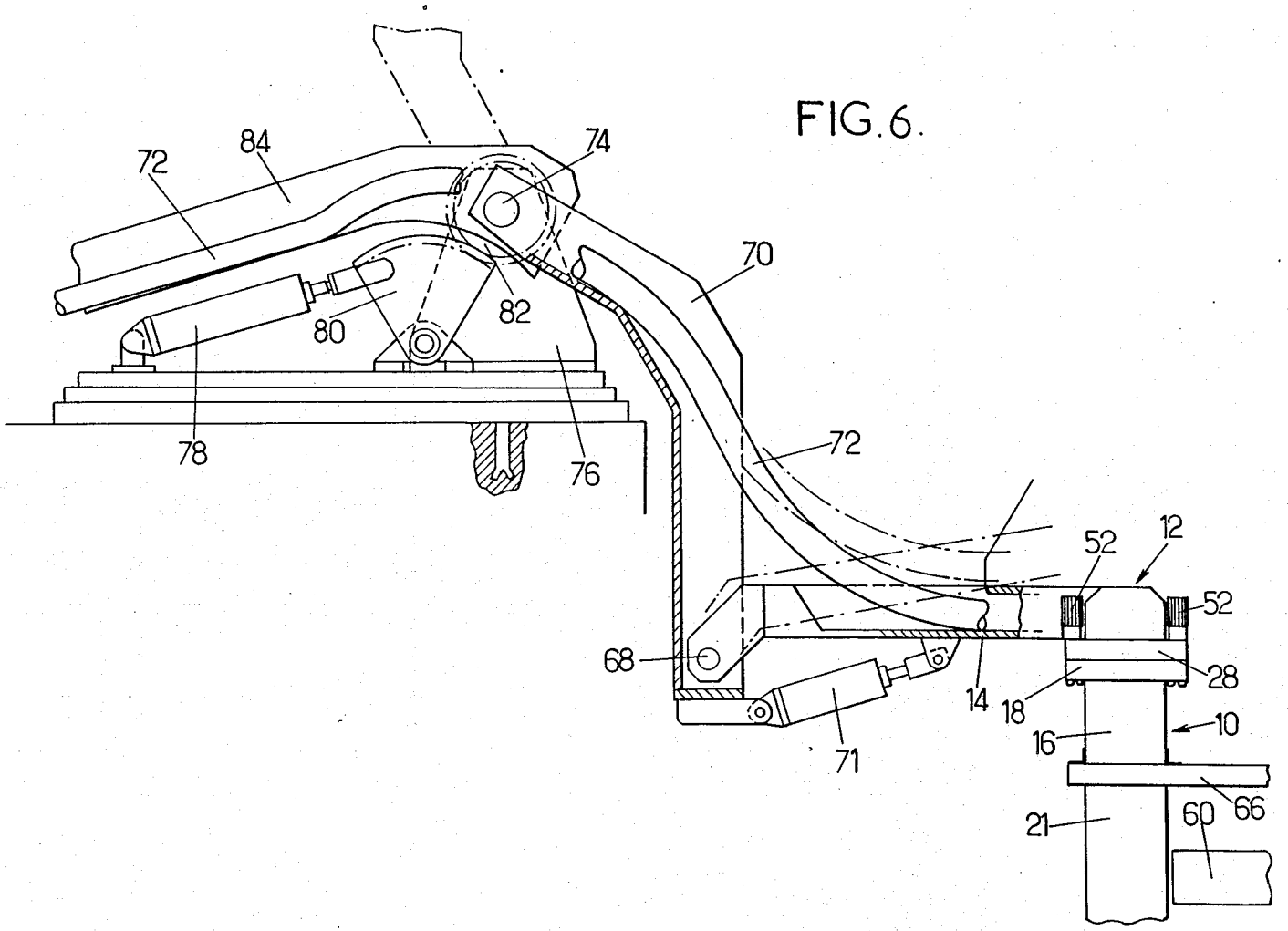
FIG. 6 is a schematic representation of a mechanism for operating the second assembly of a connector of the invention.

FIG. 6 shows a possible construction of a mechanism for connecting and disconnecting a connector of the kind shown in FIGS. 1 to 4 for a nuclear reactor. In FIG. 6, the required universal or Cardan joints have not been shown. The joint of base unit 10 will generally be placed above a slab 66 for protection against missiles in case of accident. Plug assembly 12 is carried by an arm 14 which is substantially horizontal and is immersed in the pool of the reactor when the connector is coupled. Arm 14 is pivotally mounted on a horizontal axle 68 fixed to a raising beam 70. An actuating power cylinder 71 connects beam 17 and arm 14 and is arranged to move the latter from a rest position (shown with full lines in FIG. 6) to a position in which the plug is disconnected (shown with dashdot lines). The beam further constitutes a channel for supporting and guiding the cable 72 whose conductor wires are connected to the contact elements of plug 12. The end of beam 17 remote from that which carries the power cylinder 71 is provided with trunnions 74 allowing it to pivot on a yoke 76 fixed to the edge of the pool. Pivotal movement is controlled by an air cylinder 78 which rotates a toothed sector 80 about a horizontal shaft fixed to the edge of the swimming pool. The toothed sector 78 meshes with a toothed wheel 82 fixed to beam 70 coaxially with trunnions 74. Cylinder 78 causes beam 70 to move between the rest position shown with continuous line in FIG. 6 and a raised position, shown partially with dashdot lines, in which the mechanism and the plug assembly which it carries clears the space above the pool.

In the embodiment shown, a fixed channel 84 receives and guides the connection cables 72 towards a control panel, not shown.

The operating sequence of the mechanism when it is desired to disconnect the connectors and to clear the space above the pool, for example for removing the cover of the reactor, is as follows. All the parts being initially in the position shown with continuous lines in FIG. 6, the motors 52 are actuated so as to move plates 18 and 27 apart. Cylinder 71 is pressurized, possibly after withdrawing plate 32, for separating the plug assembly from the base assembly. The air cylinder 78 is then actuated to raise beam 70 and the members which it carries up to a position totally clearing the space above the pool.

Reconnection is caused by a reverse sequence of operations. During lowering of plug assembly 12 under the action of cylinder 71, the means 31 for rough centering (which may be provided in two perpendicular directions) provide a satisfactory approach of plates 28 and 18, the universal joints coming into play if required to ensure parallelism of the plates. During the final approach phase of the plates, the centering noses 48 achieve fine alignment. Finally, actuation of motors 52 clamps the plates together.

I claim:

1. A self-alignment multiple connection device having two assemblies, one of which is movable in a direction towards and away from the other, wherein:

one of the assemblies has a first mechanical connection plate and a first connection element provided with contacts and fixed to the mechanical connection plate;

the other assembly includes a second mechanical connection plate and a second connection element provided with contacts arranged and distributed for operatively engaging the contacts of the first connection element upon movement of the latter along said direction toward the first plate, said second connection element being movable with respect to said second mechanical connection plate, along said direction; and said second mechanical connection plate carries members arranged to engage the first plate and to achieve mutual centering of the two plates upon closing movement thereof along said direction, remotely controlled means for locking the plates one on the other in aligned and mutually abutting condition and drive means for moving said second connection element along said direction with respect to said second plate between a rear position in which the contacts of the first and second elements are separated from each other even when the plates are in abutting condition and a forward position in which the contacts of the two elements are in mutual engagement when the plates are in abutting condition.

2. The device as claimed in claim 1, wherein said remotely controlled means include movable means for clamping said plates against each other and motor means for retaining the clamping means in a position locking the plates on each other in mutually abutting condition.

3. The device as claimed in claim 2, wherein said movable clamping means comprises a plurality of units each having a body secured to said second plate and formed with a centering nose and a plurality of fingers pivotably mounted on the body for pivotal movement between a locking position and a position in which their overall size in a plane transversal to said direction is smaller than the cross-section of the body in said plane.

4. The device as claimed in claim 1, wherein one of said plates further includes curved precentering means, projecting beyond said plate toward the other plate.

5. The device as claimed in claim 1, wherein said plates include sealing means for separating the connection elements from the outside.

6. The device as claimed in claim 1, further comprising motor means carried by the second plate for moving said second connection element and holding it in fully engaged position.

7. The device as claimed in claim 1, wherein said other assembly is carried by a drive arm through a universal joint.

8. The device as claimed in claim 7, wherein said arm has a power cylinder for moving it between a position for mutual connection of said connection elements and a disconnected position and said arm is mounted on a lifting beam having a power cylinder for moving an assembly formed by the beam, the arm and said other assembly towards a position clearing a space situated above said first assembly.

* * * * *